US005634758A

United States Patent [19]

Leu

[11] Patent Number: 5,634,758

[45] Date of Patent: Jun. 3, 1997

[54] PROCESS AND APPARATUS FOR THE ADHESIVE CONNECTION OF THE SHEETS OF A MULTI-SHEET FOLDED PRINTED PRODUCT

[75] Inventor: Willy Leu, Pfaffikon, Switzerland

[73] Assignee: Ferag AG, Switzerland

[21] Appl. No.: 373,568

[22] Filed: Jan. 17, 1995

[30] Foreign Application Priority Data

Jan. 19, 1994 [CH] Switzerland ..... 00152/94

[51] Int. Cl.[6] ..... B42C 9/00

[52] U.S. Cl. ..... 412/8; 412/37

[58] Field of Search ..... 412/8, 37; 156/252, 156/253, 290, 295

[56] References Cited

U.S. PATENT DOCUMENTS

| | | |
|---|---|---|
| 3,951,399 | 4/1976 | Reist . |
| 4,058,202 | 11/1977 | Reist et al. . |
| 4,398,710 | 8/1983 | Hansch . |
| 4,408,754 | 10/1983 | Meier . |
| 4,408,755 | 10/1983 | Meier . |
| 4,489,930 | 12/1984 | Meier . |
| 4,684,116 | 8/1987 | Hansch . |
| 4,684,117 | 8/1987 | Honegger et al. . |
| 4,706,951 | 11/1987 | Leu . |
| 4,709,910 | 12/1987 | Honegger . |
| 4,723,770 | 2/1988 | Seidel et al. . |
| 4,735,406 | 4/1988 | Weber . |
| 4,743,005 | 5/1988 | Reist . |
| 5,052,666 | 10/1991 | Hansch . |
| 5,052,667 | 10/1991 | Hanch . |
| 5,137,409 | 8/1992 | Honegger . |
| 5,172,897 | 12/1992 | Hansch . |
| 5,193,851 | 3/1993 | Honegger . |
| 5,350,268 | 9/1994 | Muller . |

FOREIGN PATENT DOCUMENTS

| | | |
|---|---|---|
| 2011479 | 9/1990 | Canada . |
| 0390733 | 3/1990 | European Pat. Off. . |
| 0390734 | 3/1990 | European Pat. Off. . |
| 3616566 | 5/1986 | Germany . |
| 21355132 | 5/1974 | United Kingdom . |
| 2072631 | 10/1981 | United Kingdom . |
| 2106033 | 4/1983 | United Kingdom . |
| WO79/00839 | 10/1979 | WIPO . |

OTHER PUBLICATIONS

Xerox Disclosure Journal, "Binding Apparatus", Acquiviva, Thomas, vol. 1, No. 1, Jan. 1976, in 11/1AD 412/37.

*Primary Examiner*—S. Thomas Hughes
*Attorney, Agent, or Firm*—Brinks Hofer Gilson & Lione

[57] ABSTRACT

The multi-sheet, folded printed product arranged on the supporting member is penetrated by a penetration tool, from the direction of a supporting member. A pressure-exerting element acts on the printed product with a lateral compressive force. This results in a widening of the through-passage produced through the printed product. Upon withdrawal into the rest position of the penetration tool, adhesive present on the surface of the penetration tool is transferred onto the sheets in the through-passage. Once the lateral compressive force has been eliminated, the through-passage closes, which results in good distribution of the adhesive and reliable adhesive bonding.

15 Claims, 4 Drawing Sheets

PROCESS AND APPARATUS FOR THE ADHESIVE CONNECTION OF THE SHEETS OF A MULTI-SHEET FOLDED PRINTED PRODUCT

BACKGROUND OF INVENTION

The present invention relates to a process and to an apparatus for the adhesive connection of the sheets of a multi-sheet, folded printed product, such as a periodical, newspaper, brochure or the like.

A process and an apparatus of this type is described in U.S. patent application Ser. No. 08/258,096, now abandoned corresponding to Swiss CH patent application No. 01 754/93-7 and to EP patent application No. 94 107 767.9. In this disclosed arrangement, the printed product is arranged astride a saddle-like support. A carrying bar with penetration tools in the form of drive-in or boring needles is located above the support. In producing the adhesive connection, a pressing device is first lowered onto the printed product in order to hold the latter, in a defined manner, in abutment against the support. By lowering the penetration tools, through-passages are produced through the fold of the printed product. Upon forming the through-passages or upon withdrawal of the penetration tools, adhesive applied onto the outer side of the penetration tools is transferred onto the sheets over the entire length of the through-passages in order to produce punctiform adhesive bonding. These documents also disclose that the penetration tools could also be arranged on the support instead of being arranged on the carrying bar. The result would be that the drive-in movement would take place from bottom to top i.e. from the inner side of the printed product to the outer side thereof. In this arrangement, however, there is the danger that, upon withdrawal of the penetration tool which has adhesive on its surface, adhesive is rubbed off on the outer side of the outermost sheet and that adhesive is drawn in onto the inner side of the innermost sheet. If the printed product is not fully folded immediately after the introduction of the adhesive, the printed product may no longer be able to be fully folded or no longer be able to be opened fully due to the halves of the innermost sheet sticking together adjacent to the fold. Furthermore, the support may be soiled by adhesive if the printed product is moved along the support after the adhesive is introduced. Adhesive rubbed off on the outer side of the printed product may soil other printed products or parts of the apparatus. Further processing may also be impaired. For example, during stacking of printed products, adhesive which has not yet dried may result in the printed products sticking together.

An object of the present invention is thus to provide a process and an apparatus for the adhesive connection of the sheets of a multi-sheet folded printed product, wherein the adhesive is transferred onto the sheets exclusively in a through-passage.

SUMMARY OF THE INVENTION

This object and other objects are achieved by a process an apparatus wherein the folded printed product is arranged on a supporting member which keeps the two product halves spread apart. A penetrating tool penetrates the printed product from its inner side to form a through-passage in the region of the fold of the printed product. Adhesive is applied to the penetration tool after it has penetrated the printed product. Upon withdrawal of the penetration tool a lateral compressive force is exerted on the printed product from the outer side in order to widen the through-passage and to transfer the adhesive to the sheets in the through-passage.

Exerting a lateral force on the printed product from the outer side results in the through-passage being spread apart in the direction transverse with respect to the support. It consequently assumes a funnel-like shape. The outer printed sheets, upon withdrawal of the penetration tool, thus do not butt against the surface thereof, but are spaced apart therefrom. Consequently, adhesive cannot be rubbed off on the outer side of the outermost sheet, and the transfer of the adhesive onto the sheets takes place in the interior of the through-passage. At the same time, the lateral compressive force ensures that the adhesive is rubbed off fully from the penetration tool, within the through-passage, by means of the sheets and that no adhesive can pass onto the inner side of the innermost printed sheet. Once the lateral compressive force has been eliminated, the widening closes due to the inherent elasticity of the printed product, this effecting reliable distribution of the adhesive onto all the printed sheets along the surface of the through-passage. All the printed sheets are thus reliably connected to one another.

In a particularly preferred embodiment the lateral compressive force is applied from both sides on the printed product. This results in a particularly good arrangement for spreading-apart of the through-passage.

In another particularly preferred embodiment, the folding line of the inner most sheet of the printed product is at least approximately intersected by the line of action of the lateral compressive force. This insures in a simple manner that all of the adhesive is transferred onto the printed products with a high degree of reliability.

BRIEF DESCRIPTION OF THE DRAWINGS

The present invention is explained in more detail with reference to two exemplary embodiments represented in the drawings in purely schematic form.

DETAILED DESCRIPTION OF THE PRESENTLY PREFERRED EMBODIMENTS

Figure 1:
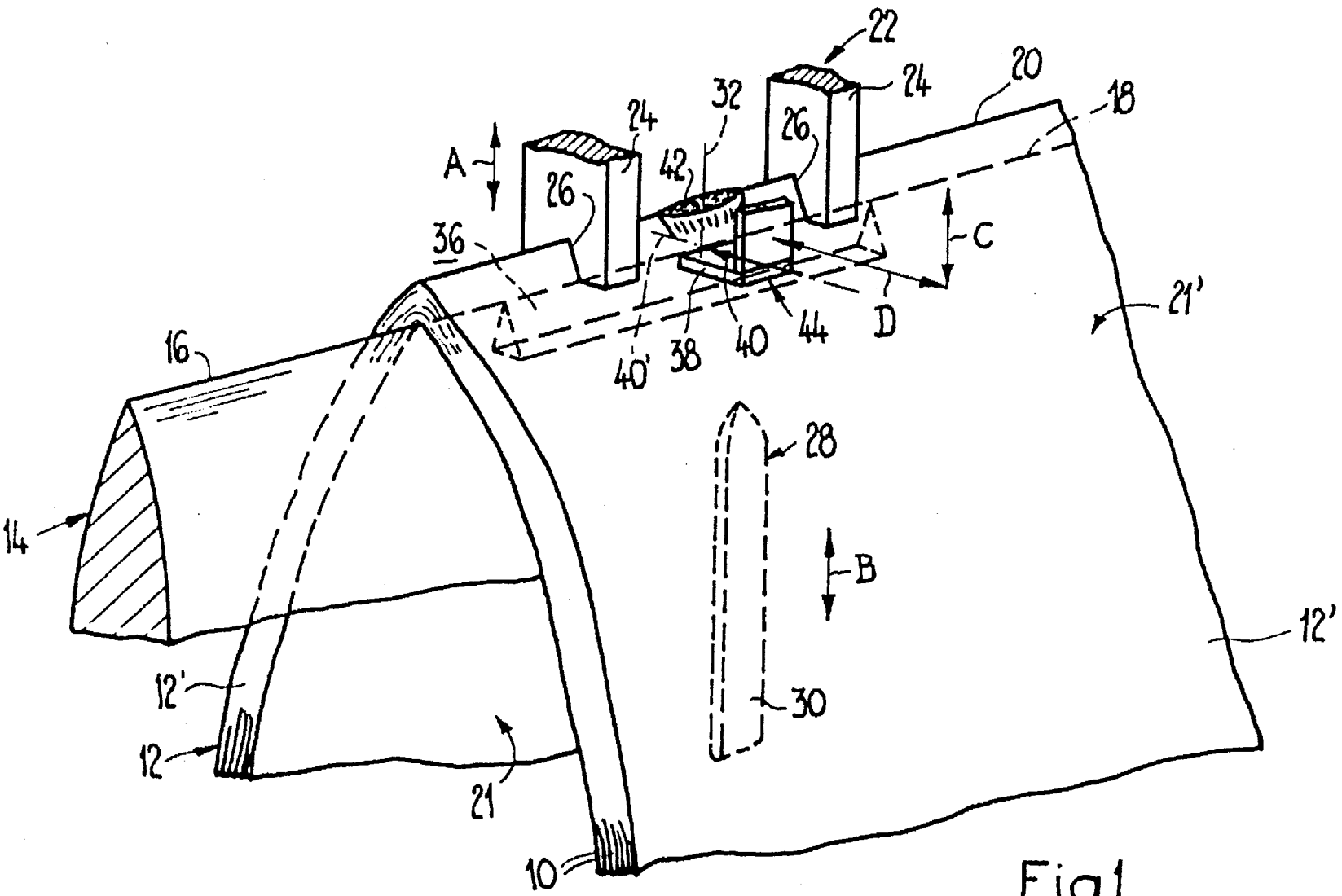
FIG. 1 shows in a perspective representation, the essential parts of a first embodiment of the apparatus according to the invention.

An embodiment of the apparatus, of the invention, for the adhesive connection of the sheets 10 of a multi-sheet folded printed product 12, such as a periodical, newspaper, brochure, etc., is shown in FIGS. 1 to 7. This embodiment includes an elongate, saddle-like supporting member 14 having a supporting edge 16. The printed product 12 is positioned astride over the supporting member 14 such that the innermost sheet 10 bears on the supporting edge 16 by means of its folding line 18. The fold of the printed product 12 is designated by 20. The product halves 12' of the folded printed product 12 are kept spread apart by a supporting member 14 having an approximately triangular cross-section. The inner side and the outer side of the printed product 12 are specified by 21 and 21', respectively.

Arranged above the supporting member 14 is a pressing and centering device 22, of which only the two pressing elements 24 are shown. On their end side directed towards the supporting member 14, they have pressing clearances 26 which are shaped to correspond to the cross section of the supporting member 14. In order to press the printed product 12 onto the supporting member 14, the pressing elements 24 is lowered, in the direction of the double arrow A, in the direction towards said supporting member 14. In order to release the printed product 12, the pressing elements 24 is raised, in the direction of the double arrow A.

A sword-like penetration tool 28 is moved (as shown by the double arrow B) from a rest position 30, in the supporting member 14, along a rectilinear movement path 32 into a penetration position 30' and back again. The longitudinal extent of the penetration tool 28 runs in the direction of the movement path 32. The movement path 32 runs approximately in the longitudinal center plane 14' of the supporting member 14 and at right angles thereto. Seen in the longitudinal direction of the supporting member 14, the penetration tool 28 penetrates the fold 20 of the printed product 12, from the inner side 21 as the penetration tool 28 moves from the rest position 30 into the penetration position 30'. The penetration tool 28 penetrates the fold 20 of the printed product 12, between the two pressing elements 24 which hold the printed product 12 in abutment against the supporting member 14 counter to the action of the penetration tool 28. As can be seen best in FIGS. 2 to 7, the supporting member 14 has a through-opening 34, which is penetrated by the penetration tool 28.

As can be seen best in FIG. 1, the supporting member 14 has a supporting-edge cutout 36. The supporting-edge cutout 36 extends symmetrically about the movement path 32, as seen in the longitudinal direction of the supporting member 14, to outside the pressing elements 24. It should, however, be noted that the printed product 12 bears on the supporting member 14 outside the two ends of the supporting-edge cutout 36.

In FIG. 1, 38 designates a tongue-like pressure-exerting element which can be moved, in the direction of the double arrows C and D, out of a standby position remote from the supporting member 14 into a pressing position, in which the pressure-exerting element 38 is shown. The pressure-exerting element 38 exerts a lateral compressive force 40 on the printed product 12 from the outside. The line of action 40' of the compressive force approximately intersects the folding line 18 of the innermost sheet 10, and thus the imaginary supporting edge 16 extended over the supporting-edge cutout 36, and the movement path 32 of the penetration tool 28. The lateral compressive force 40 presses, in the direction of the supporting-edge cutout 36, the product half 12' directed towards the pressing element 24. This results in the through-passage 42 (which was produced by the penetration tool 28) being widened or spread apart like a funnel. Seen in the longitudinal direction of the supporting member 14, the pressure-exerting element 38 acts on the printed product 12 preferably over a length which is greater than the width of the blade-like penetration tool 28 in this direction.

Figure 5:
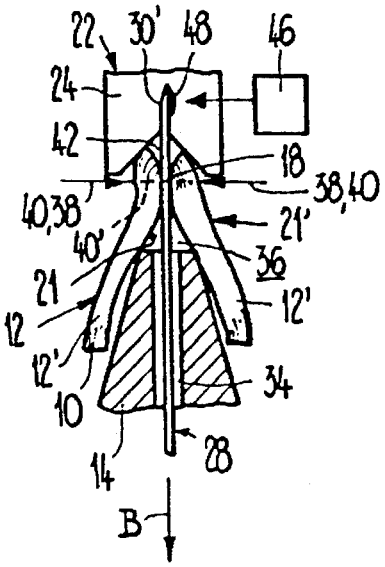
Figure 6:
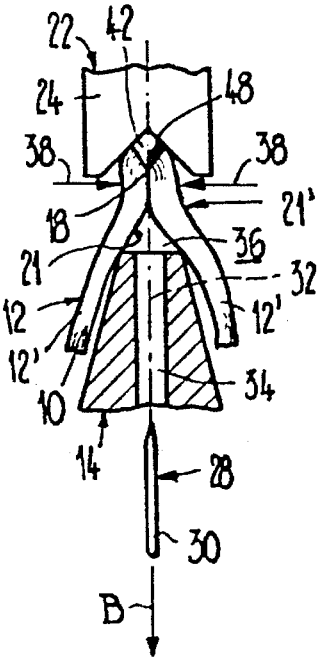
Figure 7:
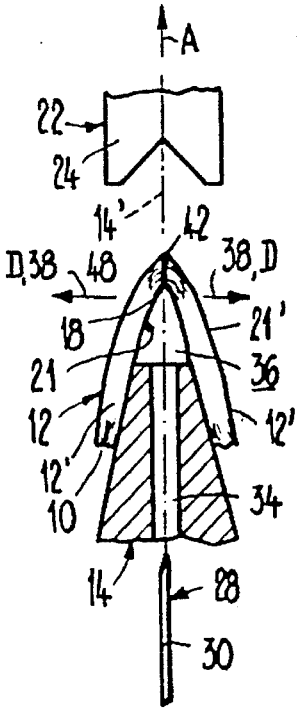

The compressive-force mechanism 44 preferably includes two pressure-exerting elements 38, as is specified in FIGS. 5 to 7 by the correspondingly designated arrows. The two pressure-exerting elements 38 when moved into the pressing position exert, on the two product halves 12', lateral compressive forces 40 which are directed towards one another. This results in the through-passage 42 being spread apart towards the top in the form of a funnel symmetrically with respect to the longitudinal center plane 14' (FIGS. 5 and 6).

For completeness, it should be mentioned that the pressure-exerting elements 38 can be moved from the standby position into the pressing position and back again by means of known drive mechanisms, for example piston/cylinder units. In order to be able to process printed products 12 of different thicknesses without adjusting the apparatus, both the pressure-exerting elements 38 and the pressing elements 24 are preferably supported in a resilient manner.

As is shown schematically in FIG. 5, an adhesive-application device 46 is arranged above the supporting member 14. Adhesive 48 is applied, by this device, onto the penetration tool 28 when it is located in the penetration position 30'.

Figure 2:
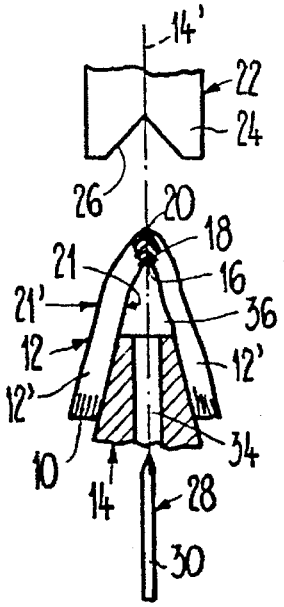
FIGS. 2 to 7 show the vertical section of the apparatus shown in FIG. 1, at six different points in time of an operating cycle.
Figure 3:
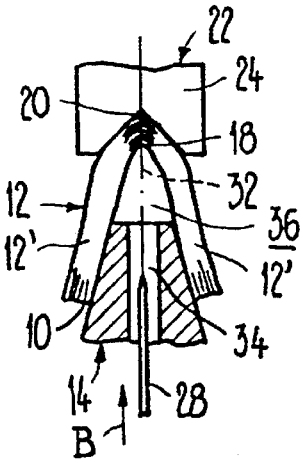
Figure 4:
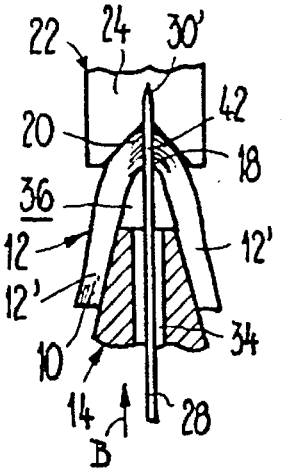

Preferably, the supporting member 14 is used as a collecting path on which folded sheets 10 are laid down astride one another. Then, by moving along the supporting member 14 and/or moving along the supporting member 14 with the printed product 12 arranged thereon, the resulting printed product 12 passes, in the direction transverse with respect to the longitudinal extent of the supporting member 14, to an adhesive-bonding station. In this arrangement, the pressing elements 24 are located in their upper end position and the penetration tool 28 is located in the rest position 30, as is shown in FIG. 2. By lowering the pressing elements 24, the printed product 12 is pressed in the direction of the supporting member 14 and centered. At the same time, the penetration tool 28 is made to move upwards, in the direction of the arrow B, to the penetration position 30' (FIG. 3). During this movement, the penetration tool 28 penetrates, from the inside 21, the printed product 12 in the region of its fold 20 and produces the through-passage 42, as is shown in FIG. 4. As can be seen in FIG. 5, the adhesive-application device 46 applies adhesive 48 onto the surface of the penetration tool 28 located in the penetration position 30'. In the preferred embodiment, the adhesive-application device applies a droplet of adhesive on one flat side of the penetration tool 28, in the region of the tapered end. At the same time, the pressure-exerting elements 38 are moved out of the standby position into the pressing position. As a result, the pressure-exerting elements 38 exert the lateral compressive force 40 on the printed product 12 in order to widen the through-passage 42. Upon withdrawal of the penetration tool into the rest position 30 (FIG. 6), the adhesive 48 passes into the through-passage 42 which has been widened like a funnel, is transferred there onto the sheets 10 and rubbed off the penetration tool 28 by the sheets. In this arrangement, the cut edge of the innermost sheet 10 forms a rubbing-off edge which is pressed onto the penetration tool 28 by the lateral compressive force 40. Finally, as shown in FIG. 7 by the arrows A and D, the pressing elements 24 are raised from the printed product 12 and the pressure-exerting elements 38 are moved back into the standby position. Due to the printed product 12 being supported in a spread-apart manner on the supporting member 14 as well as the inherent elasticity of the printed product 12, the through-passage 42 closes. As a result, the adhesive 48 is distributed onto the sheets 10 along the entire surface of the through-passage 42. This results in reliable, clean adhesive bonding.

FIGS. 8 to 14 show another embodiment of the apparatus according to the invention, which is similar to the embodiment shown and described above. The same reference numerals are used for similar parts as in FIGS. 1 to 7. (The constructions and operating method are as described above with respect to the embodiments of FIGS. 1–7.)

The elongate saddle-like supporting member 14 also has a supporting-edge cutout 36. The through-opening 34 opens into this cutout. The opening has a rectangular cross section and, as seen in the longitudinal direction of the supporting member 14, extends approximately over the entire length of the supporting-edge cutout 36. A sleeve-like guide element 50 is arranged in the through-opening 34. The end walls 52 of the guide element 50 are connected to one another via sidewalls 54 which, in the basic position, run essentially parallel to the longitudinal center plane 14'. The guide element 50 projects into the supporting-edge cutout 36. The upper border 56 of the end walls and sidewalls 52, 54 lie in a surface which corresponds to the imaginary surface, of the supporting member 14, which extends over the supporting-edge cutout 36, as can be seen best in FIGS. 8 and 11. The sidewalls 54 of the guide element 50 are preferably elastically deformable.

Figure 8:
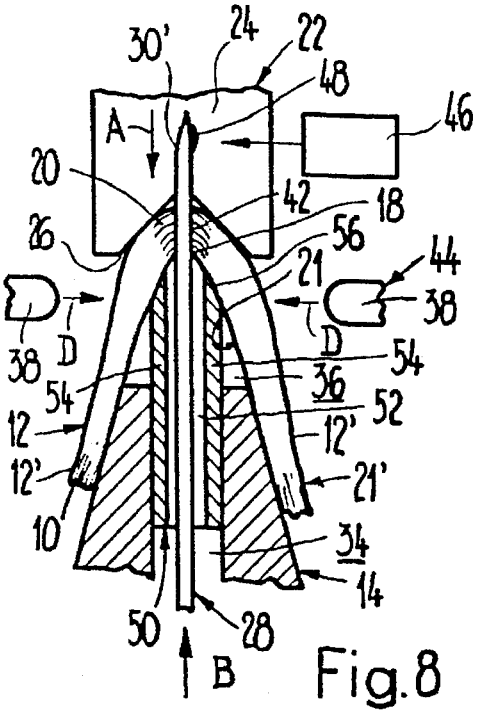
FIGS. 8 to 11 show, in the same representation as FIGS. 2 to 7, a second embodiment of the apparatus according to the invention, with a guide element in the supporting member, at four different points in time of an operating cycle.
Figure 9:
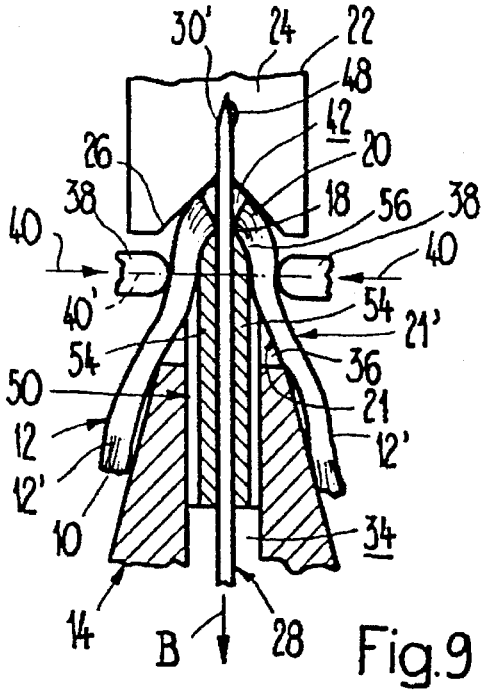
Figure 10:
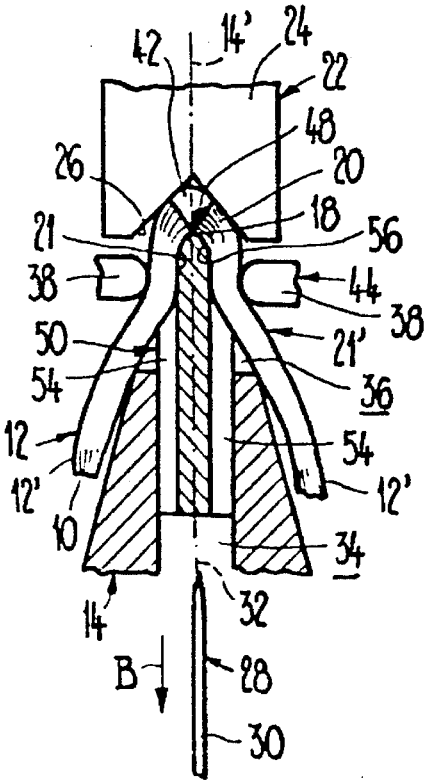
Figure 11:
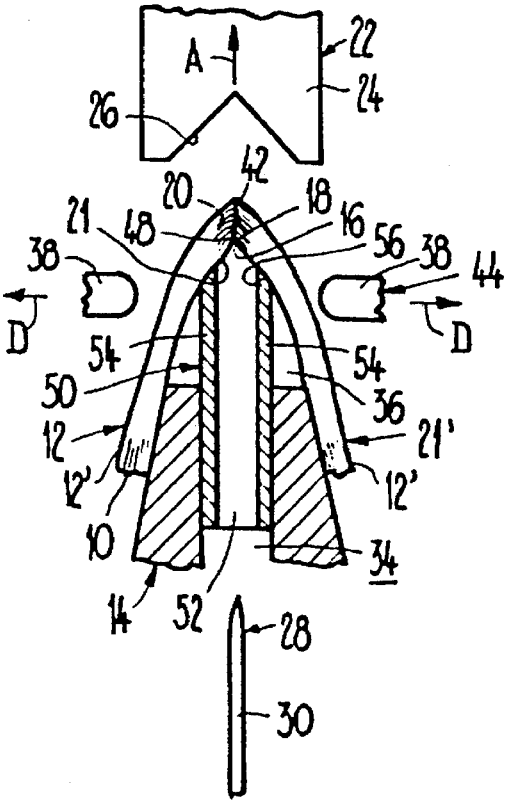
Figure 12:
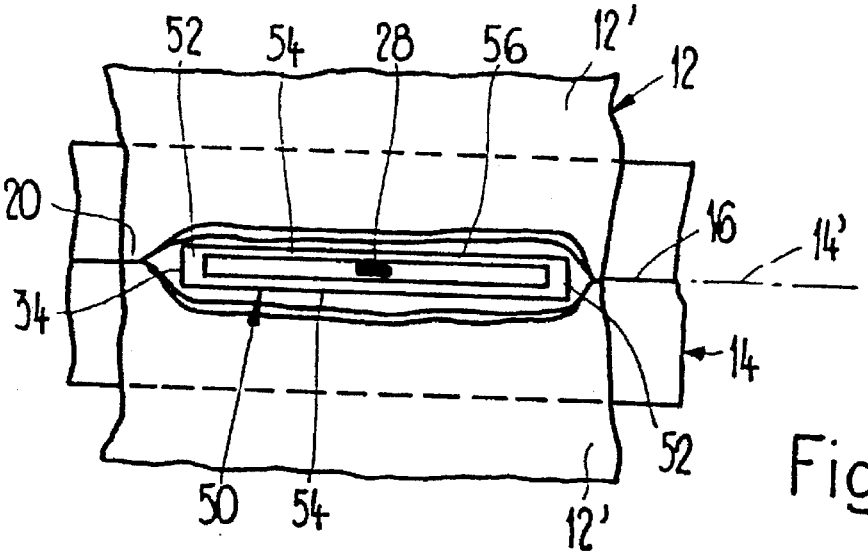
FIGS. 12 to 14 show a plan view of that embodiment of the apparatus according to the invention shown in FIGS. 8 to 11, at the same points in time of an operating cycle as in FIGS. 8 to 10.
Figure 13:
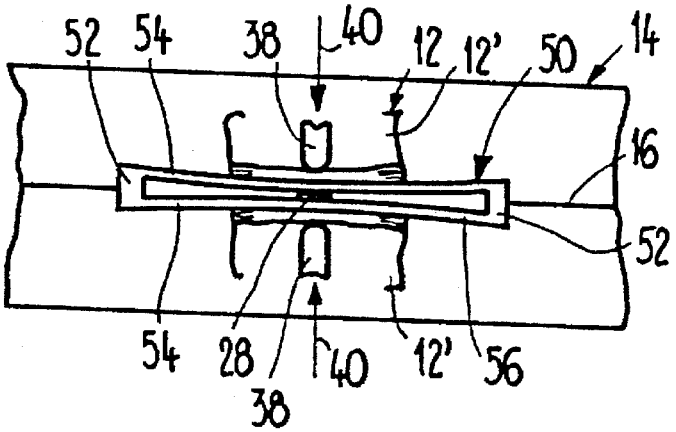
Figure 14:
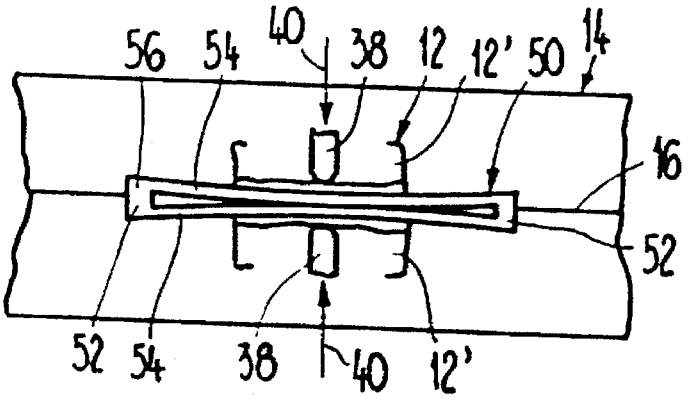

FIGS. 8 and 12 correspond to that point in time of an operating cycle as shown in FIG. 4. In these Figures, the pressing element 24 has been lowered onto the printed product 12 in the direction of the arrow A in order to hold the printed product in abutment against the supporting member 14. The penetration tool 28 has been moved from its rest position 30, in the supporting member 14, in the direction of the arrow B through the guide element 50 into the penetration position 30' (it having penetrated the printed product 12, from the inner side 21, in the region of the fold 20 and produced a through-passage 42). Adhesive 48 is applied with the adhesive application device 46 onto the surface of the penetration tool 28. The pressure-exerting elements 38 are then moved out of their standby position, shown in FIG. 8, in the direction of the arrows D into the pressing position, as is shown in FIG. 9. There they each exert a lateral compressive force 40 on the printed product 12. The line of action 40' of the compressive force intersects the sidewalls 54 in the region of the supporting-edge cutout 36. As can be seen, in particular, also, in FIG. 13, the pressure-exerting elements 38 (as seen in the longitudinal direction of the supporting member 14) are arranged in the vicinity of the penetration tool 28. This results in the sidewalls 54 being bent inwards, under the lateral compressive force 40, and being pressed against the penetration tool 28. In the direction of the arrow B, the penetration tool 28 is then withdrawn into the rest position 30 shown in FIG. 10. In this arrangement, the adhesive 48 which has previously been applied to the penetration tool 28 is transferred onto the sheets 10 in the through-passage 42. In this embodiment too, the lateral compressive force 40 applied by the pressure-exerting elements 38 results in a funnel-like spreading-apart of the through-passage 42. The position of the cut edge formed by the innermost sheet or sheets 10 is predetermined by the border 56, as can be seen in FIGS. 9 and 10. Furthermore, the lateral compressive force 40 brings the sidewalls 54 of the guide element 50 into abutment against one another as soon as the penetration tool 28 is withdrawn into the through-opening 34. See FIGS. 10 and 14. Consequently, the through-passage 42 is also closed in the region of the innermost sheet 10. The pressure-exerting elements 38 (as shown by the arrows D in FIG. 11) are then moved back into the standby position. This results in the closing of the through-passage 42. This occurs due to the inherent elasticity of the printed product 12, as well as due to the restoring force of the elastically deformable sidewalls 54. Upon closure of the through-passage 42, the adhesive 48 is distributed onto the sheets 10 along the entire surface of the through-passage 42, with the result that the now slot-shaped through-passage 42 is completely filled with adhesive 48. This results in reliable, clean adhesive bonding. Once the pressing elements 24 have been raised in the arrow direction A, the bound printed product 12 is then ready for further processing.

In the exemplary embodiments shown, the narrow sword-like penetration tool 28 has an approximately rectangular cross section. It is tapered and, in the region of the tapering, exhibits extremely sharp edges in order to form a blade. It is also possible to have a penetrating tool 28 with an oval cross section and to provide, on the penetration tool 28, clearances such as grooves, channels or the like for the adhesive. These penetration tools form a gap-shaped through-passage without removing any paper.

It is also possible to apply the adhesive to both sides of the penetration tool.

A cold-setting adhesive or hot-setting adhesive can be used. An adhesive which flows into the gaps between the sheets can also be used, in order to produce particularly good adhesive bonding.

It is also possible to process the printed products in a horizontal position. In this arrangement, the supporting member holds the product halves spread apart.

The pressing and centering device 22, as well as the compressive-force mechanism 44, may be arranged on a common securing device which can be raised and lowered in the arrow direction A. In this arrangement, the pressing elements 24 also make provision for centering of the pressing and centering device 22 and of the compressive-force mechanism 44 with respect to the supporting member 14.

The penetration tool can be driven in various ways, for example by cylinder/piston units of a slotted-link control means, etc. The same also applies for the pressing and centering device 22 and the compressive-force mechanism 44.

For completeness, it should be mentioned that, in a preferred embodiment, the printed products 12 are not supported, or are supported in an elastically yieldable manner, in the region of the supporting-edge cutout 36, i.e. in a portion of a border region along the fold 20. By means of the lateral compressive force 40, the product halves 12' are then bent inwards in this region and additionally pressed together. It is, however, also possible to dispense with a supporting-edge cutout 36 and to support the printed product 12 along the entire folding line 18 of the innermost sheet 10. In this case too, the lateral compressive force 40 widens the through-passage 42 since folded multi-sheet printed products 12, in particular in the region of the fold 20 and in an adjoining border region, split between the sheets 10 as a result of the inherent elasticity and thus have a greater thickness than in the area of the border region remote from the fold 20.

In the embodiment described above wherein the printed product is supported in the border regions adjoining the fold, considerable spreading-open of the through-passage is achieved over its length, i.e. in particular also in the vicinity of its ends, as seen in the direction of the folding line. Moreover, the restoring force for closing the through-passage is increased in a simple manner.

The embodiment with the guide element 50 results in considerable differences in the point of action of the lateral compressive force, with the reliable transfer of the adhesive remaining constant.

It is particularly advantageous if the line of action of the lateral compressive force intersects the sidewalls of the guide element, as described above. This ensures, in a simple manner, spreading-open of the through-passage as far as the innermost sheet, with the result that the latter also comes into contact with adhesive in a reliable manner. At the same time, adhesive is also prevented from being able to pass onto the inner side of the innermost sheet.

Advantageously, the lateral compressive force is eliminated as soon as the penetration tool has left the through-passage. Consequently, even very rapidly setting adhesive can be used since the through-passage is closed again very rapidly.

The embodiment wherein the printed product is held in abutment counts to the force of action of the penetration tool assures that the printed product reliably butts against the support under all conditions. Consequently, the mutual displacement of printed sheets is prevented, resulting in high-quality printed products.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. A process for the adhesive connection of the sheets of a multi-sheet printed product, said printed product being folded alone a fold such that the printed product is separated into two portions, comprising the steps of:

arranging the printed product on a supporting member such that its inner side rest on the supporting member and its outer side is exposed which keeps the two portions of the printed product spread apart;

penetrating the printed product from its inner side with a penetration tool to form a through-passage in the region of the fold of the printed product;

after the penetration tool has penetrated the printed product, applying adhesive to the surface of the penetration tool;

withdrawing the penetration tool; and upon withdrawal of the penetration tool, exerting a lateral compressive force on the printed product from the outer side in order to widen the through-passage and to transfer the adhesive onto the sheets in the through-passage.

2. The process as claimed in claim 1, wherein the step of exerting a lateral compressive force comprises exerting a lateral compressive force on each of said two portions from their outer sides.

3. The process as claimed in claim 1, wherein the fold produces a fold line, the fold line on the inner side being formed in the innermost sheet of the printed product is at least approximately intersected by the line of action of the lateral compressive force.

4. The process as claimed in claim 1, wherein the step of arranging the printed product comprises arranging the printed product to be supported by the supporting member, in a border region adjoining the fold, exclusively outside the through-passage to be formed, as seen in direction of the fold.

5. The process as claimed in claim 4, wherein the printed product is supported by a guide element which is penetrated by the penetration tool, is arranged on the supporting member and has elastically deformable sidewalls, and the lateral compressive force presses the printed product against the sidewalls and presses the latter into abutment against the penetration tool.

6. The process as claimed in claim 5, wherein a line of action of the lateral compressive force is intersecting the sidewalls of the guide element.

7. The process as claimed in claim 1, further comprising eliminating the lateral compressive force on the printed product once the penetration tool has left the through-passage.

8. The process as claimed in claim 1, further comprising holding the printed product in abutment against the supporting member counter to the force action of the penetration tool.

9. An apparatus for the adhesive connection of the sheets of a multi-sheet, folded printed product, said folded printed product being folded along a fold such that the printed product is separated into two portions, comprising:

a supporting member supporting the printed product such that its inner side rest on the supporting member and its outer side is exposed, and the supporting member keeps the two portions of the printed product spread apart;

a penetration tool moveable, transversely with respect to the supporting member, from a rest position into a penetration position and back again, the penetration tool forming a through-passage through the printed product, arranged on the supporting member, in the region of its fold, in a direction away from the supporting member;

an adhesive-application device applying adhesive onto the penetration tool when the penetration tool is located at least approximately in the penetration position; and a compressive-force mechanism disposed to exert a lateral compressive force on the printed product on its outer side in order to widen the through-passage and to transfer the adhesive onto the sheets in the through-passage.

10. The apparatus as claimed in claim 9, wherein the compressive-force mechanism includes at least two pressure-exerting elements which can be moved, out of a standby position remote from the supporting member, towards one another, in the direction transverse with respect to the supporting member, into a pressing position and back again.

11. The apparatus as claimed in claim 9, wherein the supporting member includes a cutout, and the line of action of the compressive-force mechanism intersects the movement path of the penetration tool.

12. The apparatus as claimed in claim 9, wherein the supporting member includes a cutout in which there is arranged a guide element having elastically deformable sidewalls for supporting the printed product, and the line of action of the compressive-force mechanism intersects the sidewalls in order to press the printed product against the sidewalls and to press the latter into abutment against the penetration tool.

13. The apparatus as claimed in claim 12, further comprising a centering and product-pressing device which hold the printed product in abutment against the supporting member counter to the force action of the penetration tool.

14. A process for the adhesive connection of the sheets of a multi-sheet, folded printed product, said printed product being folded along a fold such that the printed product is separated into two portions, comprising the steps of:

arranging the printed product on a supporting member such that its inner side rest on the supporting member and its outer side is exposed, and said supporting member keeps the two portions of the printed products spread apart;

penetrating the printed product from its inner side with a sword-like penetration tool to form a through-passage in the region of the fold of the printed product;

after the penetration tool has penetrated the printed product, applying adhesive to the surface of the penetration tool;

withdrawing the penetration tool; and upon withdrawal of the penetration tool, widening the through-passage to thereby transfer the adhesive onto the sheets in the through-passage.

15. An apparatus for the adhesive connection of the sheets of a multi-sheet, folded printed product, said printed product being folded such that the printed product is separated into two portions, comprising:

a supporting member supporting the printed product and keeping the two portions of the printed product spread apart;

a sword-like penetration tool moveable with respect to the supporting member to penetrate the printed product and form a through-passage through the printed product;

an adhesive-application device applying adhesive onto the penetration tool, the adhesive application device disposed such that the application of the adhesive onto the penetration tool occurs after the penetration tool has penetrated the printed product; and a widening mechanism adapted to engage the printed product to widen the through-passage as the penetration tool is being withdrawn from the printed product to thereby transfer the adhesive onto the sheets in the through-passage.

* * * * *

UNITED STATES PATENT AND TRADEMARK OFFICE

CERTIFICATE OF CORRECTION

PATENT NO. : 5,634,758

DATED : June 3, 1997

INVENTOR(S) : Willy Leu

It is certified that error appears in the above-indentified patent and that said Letters Patent is hereby corrected as shown below:

In the Claims

In claim 1, line 3, replace "alone" with --along--.

In claim 1, line 6, replace "rest" with --rests--.

In claim 4, line 5, after "in" insert --a--.

In claim 9, line 6, replace "rest" with --rests--.

Signed and Sealed this

Twenty-third Day of November, 1999

*Attest:*

Q. TODD DICKINSON

*Attesting Officer*

*Acting Commissioner of Patents and Trademarks*